US012060681B2

(12) United States Patent
Klaschka et al.

(10) Patent No.: US 12,060,681 B2
(45) Date of Patent: Aug. 13, 2024

(54) SEAMED FELT AND USE OF THE SEAMED FELT IN A TISSUE MACHINE

(71) Applicant: Voith Patent GmbH, Heidenheim (DE)

(72) Inventors: Susanne Klaschka, Cologne (DE); Robert Eberhardt, Ellwangen (DE); Hubert Walkenhaus, Kerpen (DE)

(73) Assignee: Voith Patent GmbH, Heidenheim (DE)

( * ) Notice: Subject to any disclaimer, the term of this patent is extended or adjusted under 35 U.S.C. 154(b) by 114 days.

(21) Appl. No.: 17/608,611

(22) PCT Filed: Mar. 12, 2020

(86) PCT No.: PCT/EP2020/056719
§ 371 (c)(1),
(2) Date: Nov. 3, 2021

(87) PCT Pub. No.: WO2020/224835
PCT Pub. Date: Nov. 12, 2020

(65) Prior Publication Data

US 2022/0228318 A1 Jul. 21, 2022

(30) Foreign Application Priority Data

May 3, 2019 (DE) ..... 102019111443.8

(51) Int. Cl.
*D21F 7/08* (2006.01)
*D21F 3/02* (2006.01)
(Continued)

(52) U.S. Cl.
CPC ..... *D21F 7/083* (2013.01); *D21F 3/0227* (2013.01); *D21F 3/045* (2013.01); *D21F 7/10* (2013.01); *D21F 11/14* (2013.01)

(58) Field of Classification Search
CPC ..... D21F 7/083; D21F 3/0227; D21F 3/045; D21F 7/10; D21F 11/14; D21F 3/0281; D21F 3/02; D21F 3/04
See application file for complete search history.

(56) References Cited

U.S. PATENT DOCUMENTS 6,235,160 B1 * 5/2001 Tietz ..... D21F 3/045 162/358.3
6,514,386 B2 2/2003 Watanabe
(Continued)

FOREIGN PATENT DOCUMENTS

DE 19756422 A1 6/1999
DE 60105700 T2 2/2005
(Continued)

*Primary Examiner* — Abbas Rashid
*Assistant Examiner* — Matthew M Eslami
(74) *Attorney, Agent, or Firm* — Laurence A. Greenberg; Werner H. Stemer; Ralph E. Locher

(57) ABSTRACT

A seamed felt for use in a machine for producing a tissue web has a single-layer or multilayer base structure and at least one layer of non-woven fibers. The base structure has a textile structure with MD threads which form seam loops at the two front edges of the base structure. The fabric can be made endless by connecting its front edges by way of a seam. The seam can be formed by interlocking the seam loops of the two front edges and introducing a push-in element. The MD threads wholly or predominantly have a diameter between 0.25 mm and 0.45 mm, in particular between 0.3 mm and 0.35 mm, and the thread density of the MD threads is more than 37%, in particular between 37% and 45%. There is also described a corresponding machine and a method for producing a tissue web.

20 Claims, 2 Drawing Sheets

(51) Int. Cl.

| | |
|---|---|
| ***D21F 3/04*** | (2006.01) |
| ***D21F 7/10*** | (2006.01) |
| ***D21F 11/14*** | (2006.01) |

(56) References Cited

U.S. PATENT DOCUMENTS

| | | | | |
|---|---|---|---|---|
| 2004/0094281 | A1* | 5/2004 | Hansen | D21F 7/083 162/900 |
| 2016/0145810 | A1* | 5/2016 | Miller, IV | D21H 27/005 162/111 |
| 2017/0044718 | A1 | 2/2017 | Wich | |
| 2021/0017708 | A1 | 1/2021 | Eberhardt et al. | |

FOREIGN PATENT DOCUMENTS

| | | | | |
|---|---|---|---|---|
| DE | 102011004565 | A1 | 8/2012 | |
| DE | 102018105956 | A1 | 9/2019 | |
| EP | 1 270 807 | A1 * | 1/2003 | D21F 5/00 |
| EP | 1167115 | B1 | 9/2005 | |
| EP | 2602387 | B1 | 7/2016 | |
| NO | 2014172594 | A1 | 10/2014 | |

* cited by examiner

SEAMED FELT AND USE OF THE SEAMED FELT IN A TISSUE MACHINE

FIELD AND BACKGROUND OF THE INVENTION

The invention relates to a seamed felt for a machine for producing a tissue web, and a machine and a method for producing a tissue web with such a fabric. The seamed felt comprises at least one layer of nonwoven fibers and a base structure, which consists of a woven material having MD threads and CD threads, which form seam loops at the two front edges of the base structure. The seamed felt can be made endless by connecting its front edges by means of a seam, and the seam can be implemented by interlocking the seam loops of the two front edges and the insertion of a push-in element.

The production of tissue or hygienic papers is still a rapidly growing market. A machine such as is typically used in tissue production is described in EP 1 167 115 B1. As is generally the case in paper production, here, too, a fibrous material suspension is applied between two fabrics and dewatered by evacuation. After that, the fibrous web is further dewatered in a press and then further dried thermally.

The water pressed out of the web is absorbed by the fabric and, after the fibrous web has been removed, is removed from the fabric again. This is carried out by means of suction boxes, so-called Uhle boxes, as described by way of example in EP 2 602 387 B1.

The fibrous web is formed on the same fabric in the former and then transported into the press. EP 1 167 115 designates this fabric as a water-absorbing carrier belt. This carrier belt is normally a felt, which is also designated as a forming felt. Nowadays, these forming felts are largely designed as endless felts.

However, pulling comparatively long endless felt loops onto the tissue machine is very time consuming and can lead to damage to the felt. During the production of graphic papers and packaging papers, seamed felts are therefore increasingly used as press felts. These are drawn into the machine and after that the seam is closed in the machine. However, the use of such seamed felts as a forming felt of a tissue machine has hitherto not been possible. This is because the nonwoven overlay has a weak point at the seam location. As it passes through the former, the stock jet from the headbox strikes this seam location. Since tissue machines are normally operated at high production speed, this stock jet also strikes the forming felt at high speed. As a result, the seam location is subjected to high stress. Thus, damage occurs at the seam location even after a short period of use.

SUMMARY OF THE INVENTION

It is therefore an object of the invention to propose a seamed felt which is suitable for use as a forming felt of a tissue machine.

It is also an object of the invention to propose a seamed felt with an increased service life when used as a forming felt of a tissue machine.

It is additionally an object of the invention to propose a machine and a method for its operation which ensures reliable production of a tissue web.

It is a further object of the invention to propose a conversion solution for existing installations which can be implemented with little or no outlay.

The objects are achieved completely by a seamed felt as claimed in the characterizing clause of claim 1, a machine as claimed in claim 9 and a method as claimed in claim 14. Further advantageous features of the embodiment according to the invention will be found in the sub-claims.

With regard to the fabric, the object is achieved by seamed felt for use in a machine for producing a tissue web. The seamed felt comprises a single-layer or multilayer—in particular two-layer, base structure, which has a textile structure with MD threads which form seam loops at the two front edges of the base structure, wherein the seamed felt can be made endless by connecting its front edges by means of a seam, and this seam can be implemented by interlocking the seam loops of both front edges and the insertion of a push-in element. Furthermore, the seamed felt comprises at least one layer of nonwoven fibers. According to the invention, provision is made for the MD threads wholly or predominantly to have a diameter between 0.25 mm and 0.45 mm, in particular between 0.3 mm and 0.35 mm, and for the thread density of the MD threads to be more than 37%, in particular between 37% and 45%, in particular of a felt for use in a machine for producing a tissue web. The seamed felt comprises a base structure which has a textile structure with MD threads. Furthermore, the seamed felt comprises at least one layer of nonwoven fibers. According to the invention, provision is made for the MD threads wholly or predominantly to have a diameter between 0.25 mm and 0.45 mm, in particular between 0.3 mm and 0.35 mm, and for the thread density of the MD threads to be more than 37%, in particular between 37% and 45%.

The term "wholly or predominantly" is to be understood such that at least 90% of the MD threads, preferably 95%, in particular all the MD threads, have a diameter in the specified range.

Within the context of this application, the term "diameter of a thread" is used. In the case of round threads, this term is well-defined.

For monofilaments which deviate from the round shape, or else for threads twisted from multiple monofilaments, the diameter of the thread is to be understood to be the diameter of the smallest circle which encloses the cross section of the thread.

To determine the thread density of the MD threads, the number of threads per unit length is multiplied by their diameter and the value set in relation to the unit length.

Thus, with 10 threads/cm and a thread diameter of 0.40 mm, the result is a thread density of 10*0.4 mm/10 mm=40%.

In particular, a seamed felt according to one aspect of the invention can be used as a forming felt in a tissue machine.

The short service lives of conventional seamed felts when used as a forming felt are based on the fact that these have a comparatively thick nonwoven overlay. At the seam location, this nonwoven overlay is not continuous, however, as in the remainder of the felt, but divided. This creates a butt joint or an overlap but always a weak point. If the stock jet from the headbox strikes this weak point, nonwoven fibers can be detached at this weak point as a result. The further the nonwoven fibers are removed from the base structure, the weaker the anchoring of these fibers is. The inventors have discovered that by means of the combination of fine MD threads and a high MD thread density, the base structure can perform part of the functionality which is otherwise performed in the fabric by one or more nonwoven layers, such as, for example, evening out the pressure. This base structure permits a uniform pressure distribution through the felt, which was previously thus not possible. Experiments by the applicant have surprisingly shown that felts, in particular seamed felts with such base structures, can manage with a lesser nonwoven overlay. As a result of a reduction in the thickness of the nonwoven layer, the stability of the seam location is improved, as described. Firstly, the thinner nonwoven overlay offers a smaller area of attack for the stock jet. In addition, the particularly susceptible nonwoven fibers of the nonwoven layers further removed from the base structure are omitted, and the service life of the forming felt in the tissue machine is significantly prolonged!

As a further advantage, with a thinner felt, for example in the press of a tissue machine, nip dewatering can also further be achieved in addition to the Uhle box dewatering.

Preferably, the weight of the felt is between 750 g/m$^2$ and 1250 g/m$^2$, in particular between 900 g/m$^2$ and 1100 g/m$^2$. In special cases, weights of up to 1400 g/m$^2$ are also possible. This is the total weight of base structure and nonwoven layers, if present.

It is very advantageous for the invention if the proportion by weight of the nonwoven layers corresponds at most to the proportion by weight of the base structure, in particular at most ⅔ of the proportion by weight of the base structure.

Usually, in felts for tissue production, the proportion by weight of the nonwoven fibers is greater than that of the base structure. Normally, 60% of the total weight is nonwoven fibers and 40% is base structure.

Since, in the felts proposed here, as a result of the combination of MD fiber density and MD fiber diameter, part of the functionality of the nonwoven layer is performed by the base structure, it is possible to reduce the quantity of nonwoven fibers. As a result, lighter and thinner felts are possible.

In preferred embodiments, the fabric can have a thickness of 3.5 mm and less, preferably between 2.5 mm and 3 mm! For this purpose, the thickness is determined under a pressure of 0.1 MPa.

The relative proportion of the nonwoven fibers on the overall felt additionally decreases. Therefore, for example, it is possible to use felts in which the base structure and nonwoven layers each make up 50% of the proportion by weight. The base structure can even represent the greater proportion of the weight of the felt. If 60% of the total weight stems from the base structure and only 40% from the nonwoven fibers, then the proportion by weight of the nonwoven layers corresponds to only ⅔ of the proportion by weight of the base structure.

Over the service life of the felt, the nonwoven layers are additionally highly compressed, as a result of which important fabric properties, such as the permeability, are reduced. As a result of a lower proportion of nonwoven fibers in the overall fabric, these losses resulting from compression of the nonwoven fibers are lower, and the properties of the fabric remain for longer in a tolerable range.

In particular, it may be advantageous if the weight of the nonwoven overlay is less than 600 g/m$^2$, in particular less than 500 g/m$^2$, especially 450 g/m$^2$ or less. Alternatively or additionally, it may be advantageous if the weight of the nonwoven overlay on the paper side of the felt is less than 600 g/m$^2$, in particular less than 500 g/m$^2$, especially 450 g/m$^2$ or less. Since the stock jet from the headbox strikes the paper side, the reduction in the nonwoven overlay on the paper side is particularly advantageous.

Advantageously, the textile structure can comprise a woven material, a leno weave, a scrim or a knitted material or comprise such a material.

In preferred embodiments, provision can be made for the textile structure to be a flatweave, wherein the warp threads of the loom are the MD threads of the seamed felt. The flatweave can, for example, have a plain weave.

In the event that a woven material is used as the base structure, it should be pointed out that tubular woven materials are usually used for base structures of fabrics. These tubular woven materials are rotated by 90° for installation in the machine. As a result, the weft threads of the loom become the MD threads of the fabric, and the warp threads become the CD threads. During the production of a seamed fabric, a two-layer structure can is formed from the tubular woven material by being laid on itself. Seam loops can be formed at the front edges of the two-layer structure, for example by removing one or more CD threads.

One alternative to this is the use of a flatweave.

In EP 0 425 523 B1, Paul Sudre describes the principle of producing a seamed fabric by means of a flatweave. This technique can also be used for a seamed felt according to one aspect of this invention.

For example, the flatweave can be made endless by connecting the front ends. In turn, a two-layer structure can be formed by laying it on itself. At the front edges of the two-layer structure, seam loops can be formed by removing one or more CD threads.

Since, as a rule, the length of fabrics is considerably greater in the machine direction than their width in the CD direction, and the width of the loom is sufficiently large for the width of the machine, the necessary flatweave can most simply be implemented by weaving a sufficiently long piece, wherein the warp threads then become the MD threads in the fabric. A rotation by 90°, as in a tubular woven material, is not necessary. According to one aspect of the present invention, this is very advantageous for a fabric in the form of a seamed felt. While in a loom the warp threads can in principle be arranged as close beside one another as desired, two adjacent weft threads are necessarily spaced apart from each other as a result of the fact that the warp threads, for example in a plain weave, each change from top to bottom or vice versa between each weft thread pair. As a result of this forced spacing of the weft threads, together with the 90° rotation, such an MD thread density is impossible or possible only with very great difficulty when using very thin threads with conventional tubular woven materials.

In the case of flatweaves, on the other hand, the warp threads serving as MD threads can be arranged as close to one another as desired, as a result of which fabrics having the properties described in the invention are comparatively simple to produce.

When flatweaves are used in the base structure, in advantageous embodiments the flatweave can be made endless by connecting the front ends. This connection can be made in particular by a welded connection. Here, ultrasonic welding and laser welding, in particular laser transmission welding, have proven to be suitable welding methods. If necessary, it may be advantageous to connect the two front ends of the flatweave with the aid of a connecting element. This can be, for example, one or more thread/threads, which is/are arranged in the CD direction and connected, in particular welded, to the MD threads of the two ends.

The base structure can consist of a textile structure or comprise still further elements. In particular, the base structure can have still further textile structures, such as, for example, further woven materials.

Various materials can be used for the MD threads. Polyamides such as, for example, PA 6, PA 6.6 are suitable but also other polymers such as, for example, PET. If there are CD threads present, these can be built up from the same or another polymer.

Provision can be made for all the MD threads to be of the same type. However, different types of MD threads can also be used. As a result, for example, the fiber anchoring or the dimensional stability can be influenced. Advantageously, MD threads are monofilaments.

There are also various possibilities in the selection of the CD threads. In addition to monofilaments, multi-filaments or twisted threads can also be used.

Suitable twisted threads can consist of 4 or 6 filaments. The filaments used can have a diameter of 0.15-0.25 mm. For example, 0.2×2×2 twisted threads are very suitable.

In advantageous embodiments, all the CD threads can be designed as twisted threads. Here, both all the CD threads can consist of the same twisted thread. Alternatively, various twisted threads can also be used.

It may also be advantageous if both twisted threads and monofilaments are used as CD threads. In this case, preferably around 50% of the CD threads or more are designed as twisted thread.

A preferred embodiment, twisted threads and monofilaments can be provided alternately as CD threads. In this case, the proportion of twisted threads in the CD threads is 50% or less if, for technical reasons, individual CD threads have to be removed, for example to form the seam loops.

The high proportion of twisted CD threads has proven to be advantageous.

Surprisingly, it has transpired that the above-described two-layer base structure based on a flatweave, in conjunction with a high thread density of thin MD threads—especially in with diameters between 0.25 and 0.35 mm or 0.36 mm—and a proportion of 50% or more of twisted CD threads, results in a base structure for a fabric, especially a seamed felt, which can perform parts of the function of the nonwoven layer particularly effectively.

In this way, it is very simply possible for fabrics, in particular seamed felts, to be produced which are very thin (less than 3.5 mm or even between 2.5 mm and 3 mm) and nevertheless have the full functionality.

Because of their low thickness, such seamed felts can also be used for challenging applications, such as, for example, in tissue machines, in which conventional seamed felts would wear very rapidly because of the thickness of the nonwoven overlay.

A base structure having more than two layers—for example with an additional inlay—is in principle possible but leads to a greater thickness of the seamed felt and is therefore not a preferred solution.

In advantageous embodiments, the felt can have one or more nonwoven layers. The layer or layers can be arranged on the paper side and/or the running side of the felt.

In most cases, it will be necessary for the paper side of the seamed felt to have a certain quantity of nonwoven fibers. This quantity should not lie below 10% of the total weight of the fabric. It is also advantageous, at least for the upper side of the felt touching the paper, to provide nonwoven fibers which have a fineness between 11 and 22 dtex.

The nonwoven fibers can be made of any suitable material, in particular from a polyamide but also from an elastomer such as, for example, thermoplastic polyurethane (TPU), melt fibers, bicomponent fibers or mixtures thereof.

With regard to the machine, the object is achieved by a machine for producing a tissue web which comprises a former. The machine has at least one seamed felt according to one aspect of the invention. The seamed felt is arranged such that it runs through the former during the operation of the machine.

Tissue papers normally consist of pulp and are very lightweight papers. The mass per unit area is normally between 15 g/m$^2$ and 30 g/m$^2$. However, values of 10 g/m$^2$ or 5 g/m$^2$ are also likewise possible, as are papers with more than 30 g/m$^2$. In advantageous embodiments, the machine comprises what is known as a Crescent Former.

Furthermore, in advantageous embodiments, provision can be made for the machine to have a press device with at least one press nip, and for the seamed felt to be arranged such that it runs through the at least one press nip during the operation of the press device.

Following the initial dewatering in the former, the fibrous web can then be transported on the seamed felt into a press device, where further dewatering is carried out in the press nip.

Preferably, the press device has an extended nip, in particular a shoe nip. As compared with a likewise possible roll nip, here the residence time of the web in the nip is longer. As a result, in particular lower press pressures can be used. This is important during the production of tissue papers, since, as a result, the bulk of the web is maintained, which is an important quality parameter in tissue papers.

According to one aspect of the invention, the seamed felt can have two advantages in a tissue machine. Firstly, as a result of the thinner nonwoven layer, a longer service life of the felt is possible, despite the stressing by the former. In addition, the thinner felt permits additional nip dewatering of the tissue web in the press.

Therefore, it may also be advantageous if the press device has a wastewater trap which is set up to collect water which has been removed from the tissue web in the at least one press nip. As a result of using a felt according to one aspect of the invention—in particular in the extended nip or shoe presses—the dewatering performance of the press can also be increased by the fact that, in addition to the usual Uhle box dewatering, nip dewatering also takes place. Water (or a water-air mixture) from the tissue web is not only pressed into the felt but also through the felt. While the remaining part of the water pressed out is transported onward with the felt to a Uhle box normally placed downstream, after the press nip this water enters the surroundings as splash water or spray mist. In addition, an escape of splash water forward counter to the running direction of the web is possible. This proportion of the dewatering is designated as nip dewatering. In order to prevent soiling of the press or uncontrolled wetting of the surroundings, it is advantageous to provide one or more wastewater traps in the press device. These are arranged such that the splash water can be collected and transported away.

By means of a seamed felt according to one aspect of the invention, and if necessary following the installation of a water trap, the dewatering performance of the press device can be increased considerably with very little outlay, even in existing tissue machines.

With regard to the method, the object is achieved by a method for producing a tissue web using a machine according to one aspect of the invention.

Advantageously, provision can be made for some of the dewatering to be carried out in the press device in the form of nip dewatering, and for this water thus removed to be wholly or partly collected by a wastewater trap.

In particular, provision can be made for the nip dewatering to make up more than 10%, in particular make up between 20% and 50%, of the total dewatering quantity of the press device.

In particular, it is advantageous if the tissue machine is operated at a high speed of more than 1200 m/min, in particular more than 1500 m/min or 1800 m/min. It is precisely at high production speeds that firstly, too low a dryness after the press is the limiting factor for an increase in the production speed.

Secondly, the high production speed of the tissue machine necessitates a high jet speed in the headbox. Here, the higher strength of the seam or the nonwoven overlay of the seam is particularly advantageous.

By means of the method proposed here, the dryness after the press can be increased and, at the same time, the service life of the seamed felt can be increased, which means that high production speeds are stably and permanently possible.

BRIEF DESCRIPTION OF THE FIGURES

The invention will be explained in more detail below with reference to schematic figures, not to scale.

DETAILED DESCRIPTION OF THE INVENTION

Figure 1:
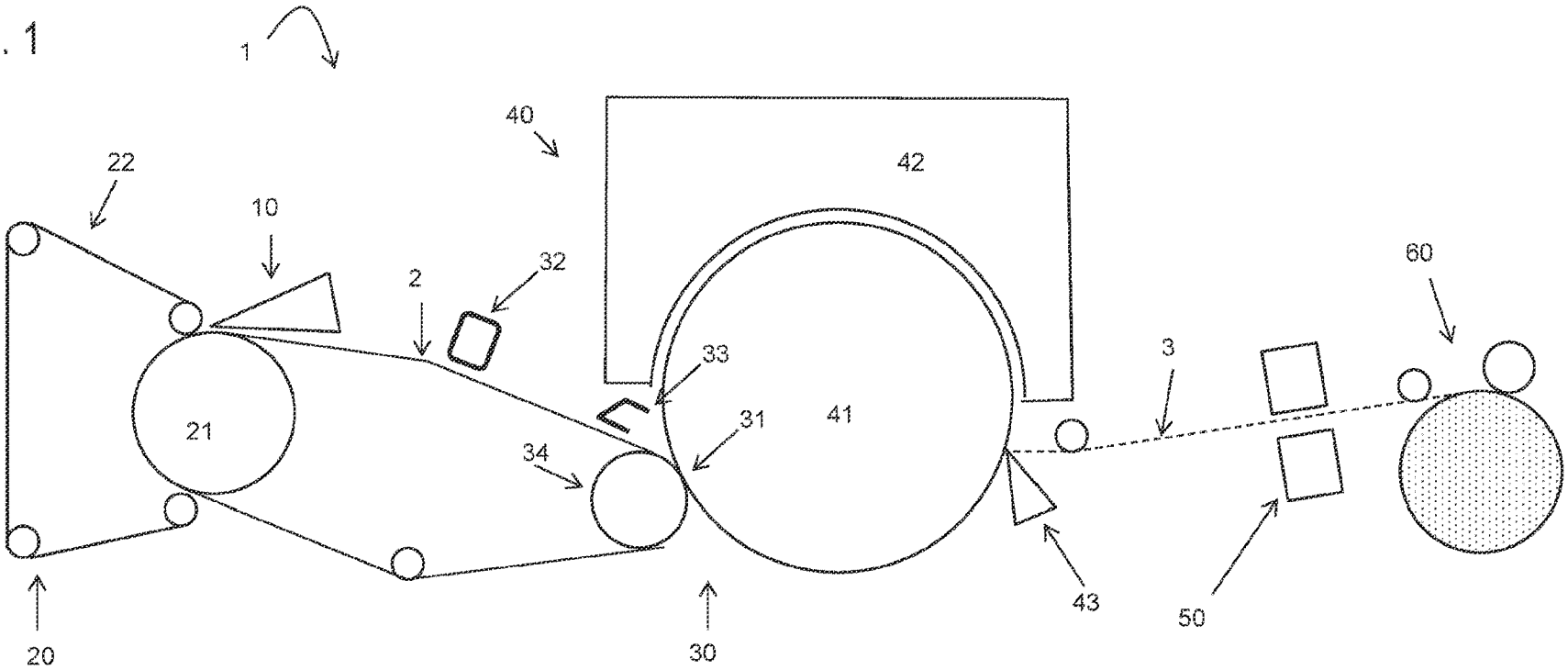
FIG. 1 shows a tissue machine according to one aspect of the invention.

FIG. 1 shows a tissue machine 1 according to one aspect of the invention. Using the example of this typical design of a tissue machine 1, exemplary aspects of the idea described here are to be explained. The invention is not restricted to this embodiment. A fibrous material suspension is applied via a headbox to a fabric 2 or between a fabric 2 and an outer wire 22. The fabric 2 is designed as a forming felt 2 in the form of a seamed felt 2. In a former 20, initial dewatering takes placed with the aid of an evacuated forming roll 21, around which the forming felt 2 partly wraps. The former 20 in FIG. 1 is designed as a Crescent Former 20, but other former types are also possible. The fibrous material web that has been produced is then transported into the press device 30, supported by the forming felt 2. In FIG. 1, the press device 30 is designed as a shoe press 30. The press nip 31 is between the shoe roll 34 and a Yankee cylinder 41. The forming felt 2 passes through the press nip 31 together with the tissue web 3. After the press nip, the web 3 runs onward on the upper surface of the Yankee cylinder 41. Here, a dryer hood 42 is arranged on the Yankee cylinder 41. By means of a creping doctor 43, the web 3 is detached from the Yankee cylinder 41 and transported onward to a reel-up 60. As shown in FIG. 1, a scanner 50 or another suitable measuring device 50, with which important parameters of the fibrous web 3 such as, for example, the thickness, moisture or mass per unit area are detected, can also be provided before the reel-up 60. If the scanner 50 is designed to be traversing, transverse profiles of these parameters can also be determined.

The fabric 2 of the machine 1 shown in FIG. 1 is advantageously a seamed felt 2 according to one aspect of the invention. Advantageously, it can comprise a base structure 100 made of a flatweave 110, in particular a plain weave, which is made endless by connecting—e.g. welding—the front ends and a two-layer structure 100 is formed by laying it on itself.

The MD threads of this base structure 100 in the embodiment all have a diameter between 0.25 mm and 0.45 mm, in particular between 0.3 mm and 0.35 mm. The thread density of the MD threads is more than 37%, preferably between 37% and 45%, particularly preferably between 39% and 43%. With a preferred weight of the felt 2 between 750 g/m$^2$ and 1250 g/m$^2$, in particular between 900 g/m$^2$ and 1100 g/m$^2$, the nonwoven overlay 200 can be reduced such that it makes up only half or less of the weight of the felt 2. In particular, the weight of the nonwoven overlay 200 on the paper side of the seamed felt 2 or even of the entire seamed felt 2 can be less than 600 g/m$^2$, in particular less than 500 g/m$^2$, especially 450 g/m$^2$ or less.

Since, in a fabric 2 according to one aspect of the invention, the base structure 100 performs part of the function of the nonwoven layers 200, this fabric 2 can be designed to be very thin. As a result, the seam location 150 or butt joint 210 offers a smaller area of attack for the stock jet. In addition, the particularly susceptible nonwoven fibers of the nonwoven layers far removed from the base structure 100 are omitted, and the service life of the forming felt 2 in the tissue machine 1 is significantly prolonged!

Furthermore, as opposed to the tissue machines 1 known from the prior art, when such a seamed felt 2 is used in the press nip 31, in particular in a shoe press nip 31, nip dewatering can be achieved. Hereby, splash water or spray mist is produced, which normally occurs after the press nip 31, but can sometimes also occur before the nip 31. In order to prevent soiling of the press 30 or uncontrolled wetting of the surroundings, it is advantageous to provide one or more wastewater traps 33 in the press device 30. In FIG. 1, a wastewater trap 33 is arranged after the press nip 31. Alternatively or additionally, a wastewater trap 33 can also be provided before the press nip 31. The wastewater trap or traps 33 pick up the proportion of the water which has been removed from the web 3 by nip dewatering. The remaining part is stored in the fabric 2 and transported away from the press nip 31. In order to remove this water from the fabric 2, in the installation shown in FIG. 1, a suction box 32, what is known as a Uhle box, is provided between press nip 31 and the headbox 10. In a method according to one aspect of the invention, the proportion of nip dewatering is more than 10%, preferably between 20% and 50%, of the total dewatering of the press 30.

Figure 2:
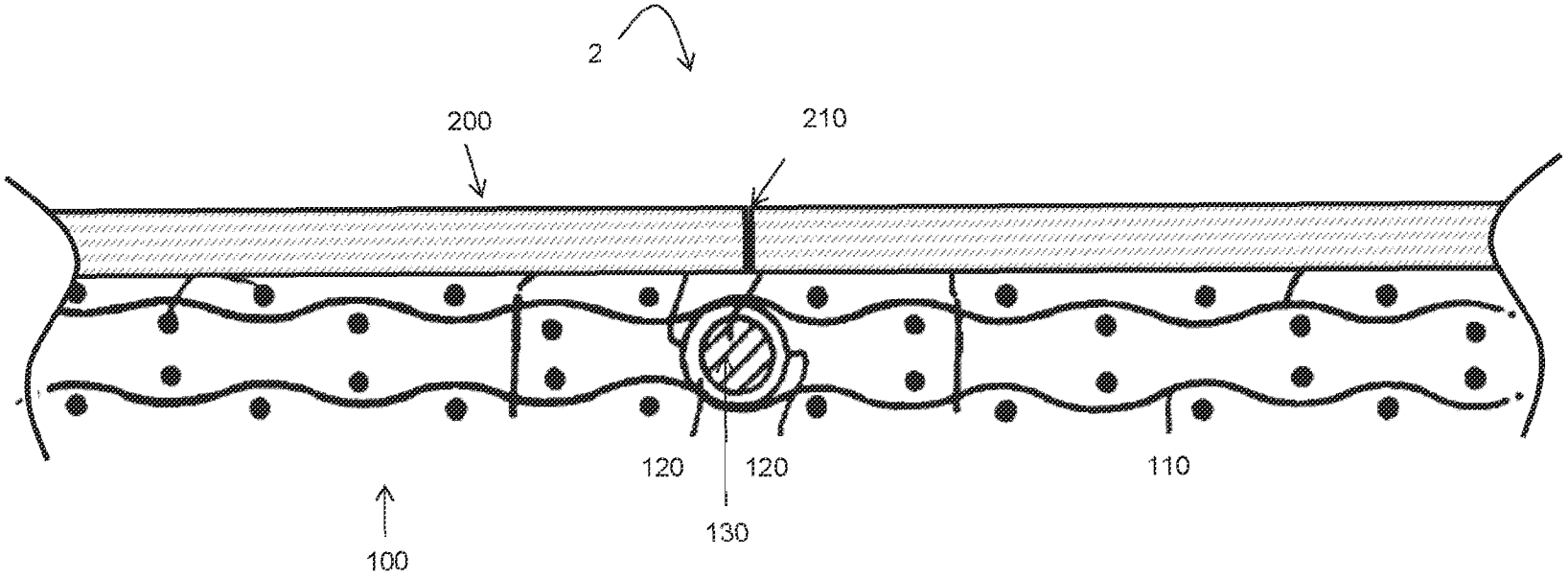
FIG. 2 shows the seam area of a seamed felt according to one aspect of the invention.

FIG. 2 shows a detail from a seamed felt 2 according to one aspect of the invention. The felt 2 shown here consists of a base structure 100 and a nonwoven layer 200 on the paper side of the felt 2. The nonwoven layer 200 can comprise one or more layers of nonwoven fibers. Likewise, a further nonwoven layer, which is not illustrated in FIG. 2, can be provided on the running side of the felt 2. The base structure 100 in FIG. 2 is a woven base structure 100. A flatweave 100 can be laid on itself by folding such that the result is the two-layer base structure shown. The ends of the flatweave 110 are advantageously connected to each other, for example by a welded connection. Seam loops 120 are formed at the front edges of the two-layer base structure 100 thus produced. For this purpose, one or more CD threads can be removed from the woven material. To close the seam, the seam loops 120 are interlocked and can be connected to each other by an element such as a pintle wire 130.

For the nonwoven layer 200, in seamed felts 2 of this type, there is the problem that this nonwoven layer 200 can be non-continuous at the seam 150 but have a butt joint 210 (possibly in the form of an overlap 210). This butt joint 210 is very critical in particular in the use as a forming felt 2. The stock jet from the headbox 10 can widen the butt joint or detach the nonwoven fibers since the anchoring, primarily of the outer nonwoven fibers, is reduced in the seam area 150. In a seamed felt according to one aspect of the invention, the base structure 100 can then perform parts of the function of the nonwoven layer 200, such as evening out the pressure. The result of this, amongst other things, is that the nonwoven layer 200 can be designed to be thinner. As a result, it becomes more difficult for the stock jet to penetrate the butt joint 210. In addition, on average the nonwoven fibers are located less far away from the woven material of the base structure 100, which improves the anchoring. As a result, a use of a seamed felt 2 with a considerably improved service life as a forming felt 2 of a tissue machine 1 is made possible.

LIST OF DESIGNATIONS

1 Tissue machine
2 Fabric, seamed felt
3 Tissue web
10 Headbox
20 Former
21 Forming roll
22 Outer wire
30 Press device
31 Press nip
32 Suction box, "Uhle Box"
33 Wastewater trap
34 Shoe roll
40 Drying apparatus
41 Yankee cylinder
42 Hood
43 Creping doctor
50 Scanner
60 Reel-up
100 Base structure
110 Flatweave
120 Seam loop
130 Pintle wire
150 Seam
200 Nonwoven layer

The invention claimed is:

1. A seamed felt for use in a machine for producing a tissue web, the seamed felt comprising:

at least one layer of nonwoven fibers;

a base structure being a woven material having machine direction (MD) threads and cross-machine direction (CD) threads, said base structure having two front edges with seam loops;

said woven material being a flatweave, said MD threads of the seamed felt being warp threads of a loom and said flatweave being made endless by connecting front ends thereof to form a two-layer structure by laying said flatweave on itself;

a seam rendering the seamed felt endless by connecting said front edges, said seam interlocking said seam loops of said front edges with a push-in element inserted therein;

at least 90% or all of said MD threads having a diameter of between 0.25 mm and 0.45 mm, and said MD threads having a thread density of more than 37%, wherein the thread density of said MD threads is determined by multiplying a number of threads per unit length by a diameter of said MD threads and setting a multiplication result in relation to the unit length.

2. The seamed felt according to claim 1, wherein the diameter of said MD threads lies between 0.3 mm and 0.35 mm, and the thread density of said MD threads lies between 37% and 45%.

3. The seamed felt according to claim 1, wherein a weight of the seamed felt lies between 750 g/m$^2$ and 1250 g/m$^2$.

4. The seamed felt according to claim 3, wherein the weight of the seamed felt lies between 900 g/m$^2$ and 1100 g/m$^2$.

5. The seamed felt according to claim 1, wherein a proportion by weight of said at least one layer of nonwoven fibers corresponds at most to a proportion by weight of said base structure.

6. The seamed felt according to claim 5, wherein the proportion by weight of said at least one layer of nonwoven fibers corresponds at most to ⅔ of the proportion by weight of said base structure.

7. The seamed felt according to claim 1, wherein said at least one layer of nonwoven fibers forms an overlay layer having a weight of less than 600 g/m$^2$.

8. The seamed felt according to claim 7, wherein said overlay layer has a weight of less than 450 g/m$^2$.

9. The seamed felt according to claim 1, wherein seam loops are formed at the front edges of the two-layer structure by removing one or more CD threads.

10. The seamed felt according to claim 1, wherein at least some of said CD threads are twisted threads.

11. The seamed felt according to claim 10, wherein at least 50% of said CD threads are twisted threads.

12. The seamed felt according to claim 1, wherein the seamed felt has a thickness of 3.5 mm or less.

13. A machine for producing a tissue web, the machine comprising:

a former; and at least one seamed felt according to claim 1 configured to run through said former during an operation of the machine.

14. The machine according to claim 13, wherein said former is a Crescent Former.

15. The machine according to claim 13, further comprising a press device with at least one press nip, and wherein the seamed felt is disposed to run through said at least one press nip during an operation of said press device.

16. The machine according to claim 15, wherein said at least one press nip of said press device is an extended nip.

17. The machine according to claim 16, wherein said at least one press nip of said press device is a shoe nip.

18. The machine according to claim 15, wherein said press device has a wastewater trap configured to collect water which has been removed from the tissue web in said at least one press nip, wherein said wastewater trap is arranged to collect and conduct away splash water.

19. A method for producing a tissue web, the method which comprises operating the machine according to claim 13 for producing the tissue web.

20. The method according to claim 19, which comprises carrying out dewatering in a press device of more than 10% by nip dewatering, as opposed to Uhle box dewatering, and removing the water removed by the nip dewatering after collection by a wastewater trap.

* * * * *